United States Patent [19]

Krenz

[11] 4,390,292

[45] Jun. 28, 1983

[54] MEANS AND METHOD FOR COMPENSATING FOR PRINT MEDIUM THICKNESS IN LINE PRINTERS

[75] Inventor: Horst M. Krenz, St. Joseph, Mich.

[73] Assignee: Zenith Radio Corporation, Glenview, Ill.

[21] Appl. No.: 317,810

[22] Filed: Nov. 3, 1981

[51] Int. Cl.[3] ..... B41J 25/00; B41J 29/00

[52] U.S. Cl. ..... 400/59; 400/55; 400/57

[58] Field of Search ..... 400/55-60

[56] References Cited

FOREIGN PATENT DOCUMENTS

| | | | |
|---|---|---|---|
| 2838627 | 3/1979 | Fed. Rep. of Germany | 400/55 |
| 55-142679 | 11/1980 | Japan | 400/55 |
| 56-62177 | 5/1981 | Japan | 400/56 |

OTHER PUBLICATIONS

Blaskonic, et al., "Forms Thickness Adjusting Device", *IBM Technical Disclosure Bulletin*, vol. 24, No. 11A, Apr. 1982, p. 5429.

*Primary Examiner*—Clifford D. Crowder

[57] ABSTRACT

Means are disclosed for use in a line printer having a print head on a carriage traversing parallel to a platen for printing characters through an inked ribbon onto a print medium drawn between the ribbon and platen. The inventive means provide for adjusting the print head position. Bracket means slidably mounted on the carriage provide for movement of the bracket toward and away from the platen. The bracket provides for mounting the print head on the carriage. A bracket adjusting member consisting of a lever in the preferred embodiment is coupled between the carriage and the bracket for manual adjustment of the spacing of the print head with respect to the platen. Pointer means are pivotally mounted on the carriage engage the bracket such that bracket movement and hence print head movement is translated into pointer movment, providing for a gross indication by means of indicia beneath the pointer of print head location with respect to the platen. Thus the spacing between print head and the platen can be adjusted by the bracket adjusting member for print media of different thicknesses.

1 Claim, 7 Drawing Figures

MEANS AND METHOD FOR COMPENSATING FOR PRINT MEDIUM THICKNESS IN LINE PRINTERS

BACKGROUND OF THE INVENTION AND PRIOR ART STATEMENT

This invention relates to computer printers, and is particularly concerned with improved means for enhancing the performance, reliability and maintainability of high-speed line printers.

Line printers are peripheral to computer systems, providing primarily for alphanumeric "hard copy" output. Printing speed is usually very high, ranging from 130 to 280 lines per minute, for example. This high speed is made possible largely by the bidirectional movement of the print head.

Line printers, once turned on, are expected to operate for long periods unattended, and with high reliability. The print medium, such as the fan-fold, edge-punched continuous form, is usually loaded in large quantities. Any necessary adjustment such as for print medium thickness, drive belt tension, or print head to platen parallelism, should be such as to be accomplished quickly and easily, and without the need for special tools or skills.

Paper thickness adjustment in the Xerox Model 630 Communications Terminal is accomplished by means of a two-position "multicopy" lever which also adjusts for print intensity. Setting the lever in its upper position moves the carriage close to the platen, and actuates a switch for the proper setting for light and medium weight paper, and form sets of up to two carbon copies. For heavier paper, or form sets of up to five copies, the multicopy lever is set to its lower position. This rocks the carriage away from the platen slightly, and deactivates the switch to enable an increased print density. The platen of the Model 630 is similar to that of a standard typewriter in that it comprises a hard rubber roller. Paper is inserted behind the platen while the platen is turned manually to bring the paper around and up in front of the platen.

In the Diablo Model 1640 line printer, adjustment for paper thickness is made by moving the roller platen toward and away from the print head, much the same as it is done in the standard typewriter.

OBJECTS OF THE INVENTION

It is a general object of this invention to enhance performance, reliability and maintainability of line printers.

It is a more specific object of this invention to simplify adjustment of line printers.

It is a specific object of this invention to provide means for compensating for print media of different thicknesses.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
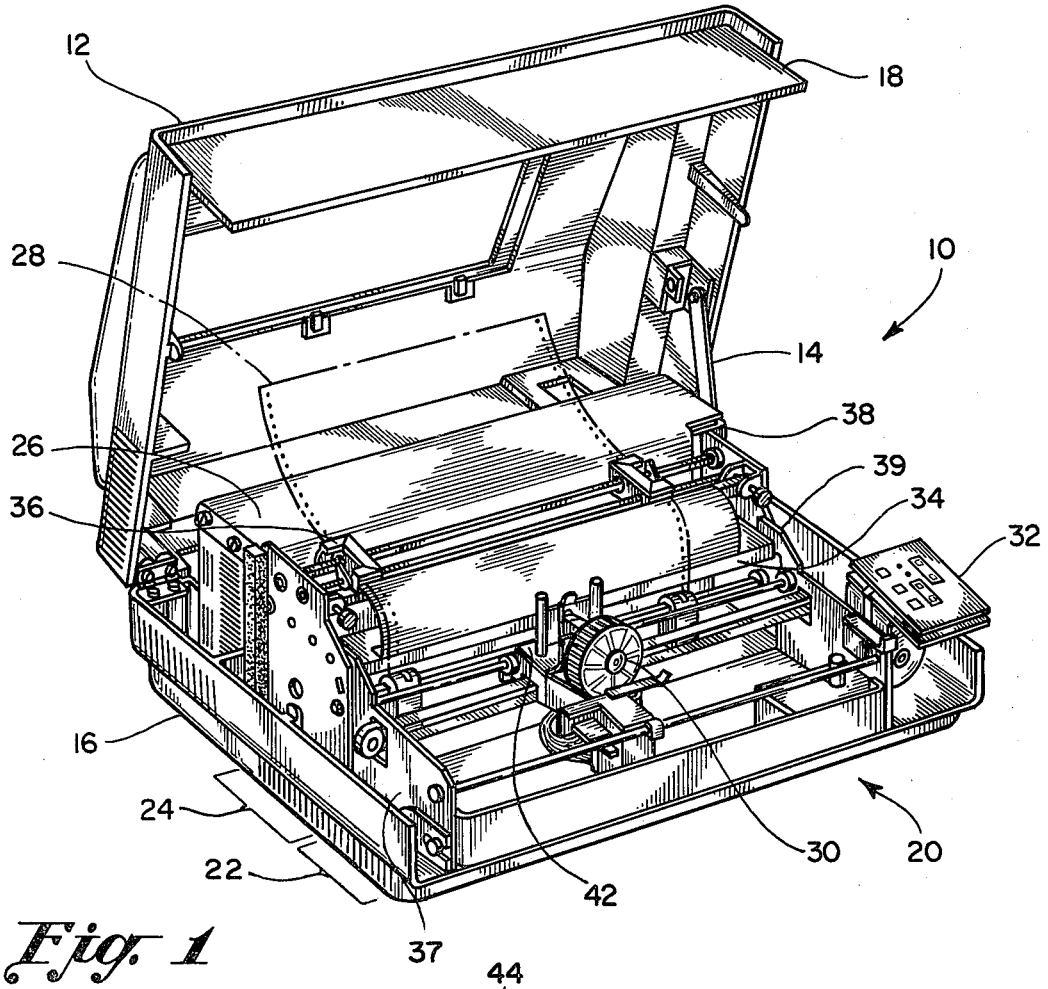
FIG. 1 is a view in perspective depicting a line printer with the cover open to show operating components.

A high-speed line printer 10 of a type to which the present invention has application is shown by FIG. 1. Cover 12 is depicted as being raised and held in an open position by cover support arm 14, which has a detented section for locking cover 12 in the open position.

The component parts of the line printer 10 are depicted as being installed in a base cabinet 16 which mates with cover 12 upon closure of cover 12. Cover 12 will be noted as having an overhanging panel 18 which enters a recess 20 at the front of base cabinet 16 when the cover is closed.

Line printer 10 consists of three basic assemblies—a print drive unit 22, (depicted in greater detail in FIG. 2) and a paper drive unit 24, as indicated by the brackets, and an electronic circuit assembly 26, shown as being covered. The print drive unit 22 and paper drive unit 24 act in concert to print characters on a print medium 28, usually paper, that is drawn between the print head 30 and platen 34 of the print drive unit 22.

The electronic circuit assembly 26 contains components for interfacing with a computer (not shown) to which the line printer 10 is peripheral. A multi-conductor electrical cable (not shown) links the line printer 10 and the computer, carrying the computer's instruction to line printer 10, and information about the line printer's status back to the computer. The primary component of the electronic circuit assembly 26 is a microprocessor which receives and interprets the instructions from the computer, controls the print head and paper advance motors, tells the computer when to send more information, and controls the flow of information inside the line printer 10. Other components in the line printer 10 are directed by the microprocessor to switch the internal voltages and currents for rapid, precise control of the print head drive motor, paper advance motor, and ribbon advance motor. The controls and indicators which govern the operation of the line printer 10 are contained on control panel 32.

The print medium 28, noted as normally being paper, is supplied to the line printer 10 from a "fan-fold" or a continuous roll in which individual sheets are distinguished by perforations lateral to the length of the paper and adjacent to the edges of the paper. The paper is normally stored in a dispenser, usually in a cabinet or stand which supports the line printer 10. Line printer 10 has an upper paper drive mechanism comprising a pair of tractor members 36 and 38, each having a toothed wheel for engaging the perforations in the print medium 28 that extend along each edge, as depicted. A lower paper drive mechanism similar to the one described is located beneath the area of the platen 34, but is not shown in FIG. 1.

Figure 2:
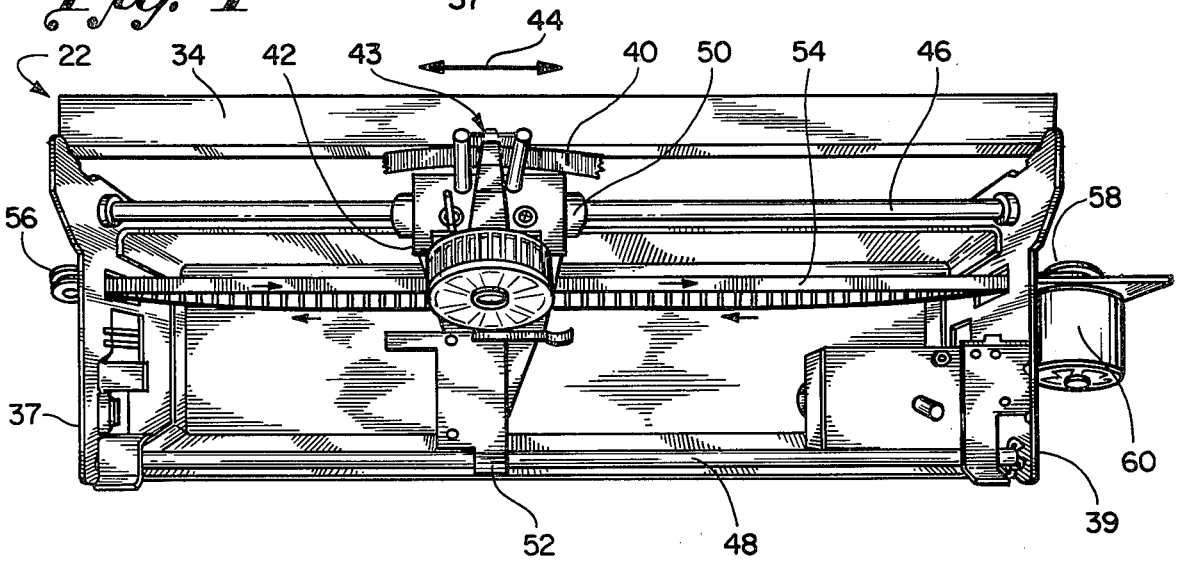
FIG. 2 is a top view in perspective showing details of an operating component shown by FIG. 1.
Figure 3:
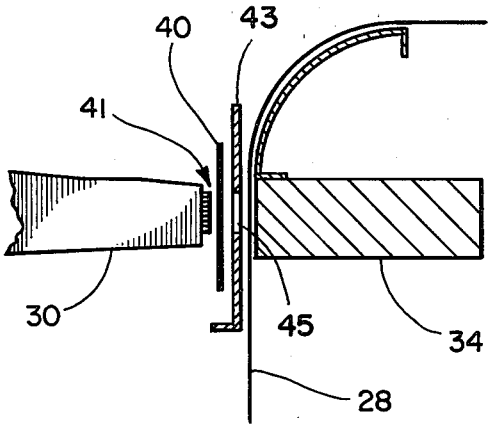
FIG. 3 is a view in cross section showing details of the relationship of components shown by FIGS. 1 and 2.

With reference additionally to FIG. 3, as the print medium 28 moves upwardly a line at a time, characters are printed by the print head 30, which traverses between a first side frame 37 and a second side frame 39 of print drive unit 22. The print medium 28 normally moves upwardly between an inked ribbon 40, a section of which is indicated in FIG. 2, and the platen 34.

Print head 30 is a standard impact printer which includes a vertically aligned array of print wires 41, the tips of which can be seen protruding from print head 30 in FIG. 3. Each wire of the array is selectively electromagnetically activated to advance toward platen 34 for printing dot-matrix characters through inked ribbon 40 onto print medium 28 drawn between ribbon 40 and platen 34. The selectively activated wires 41 produce a matrix of dots representing a desired character, for example, the letter A or the numeral 2. A ribbon shield 43 has an aperture 45 therein for passage of print wires 41.

The print head 30 is located on a carriage 42 as depicted in FIG. 2. Carriage 42 traverses parallel to the platen 34 in the directions indicated by the associated arrows 44 for printing the dot-matrix characters. Carriage 42 is shown as riding upon a pair of parallel bars 46 and 48, with moving contact with bars 46 and 48 made by slider means 50 and 52, respectively.

Carriage 42 is driven in its traverse by a flexible belt 54 close-looped around an idler pulley 56 adjacent and external to the first side frame 37, and a driven pulley 58 adjacent and external to the second side frame 39. As driven pulley 58 is rotated in either a clockwise or counterclockwise direction by print head drive motor 60, for example, guide assembly 42 and print head 30 traverse parallel to platen 34 for printing characters on print medium 28. Driven pulley 58 is indicated as being mounted adjacent and external to second side frame 39. Flexible belt 54 is shown as being a "synchronous" belt; that is, one having cogs for engagement with compatible synchronous cogged pulleys 56 and 58.

Figure 4:
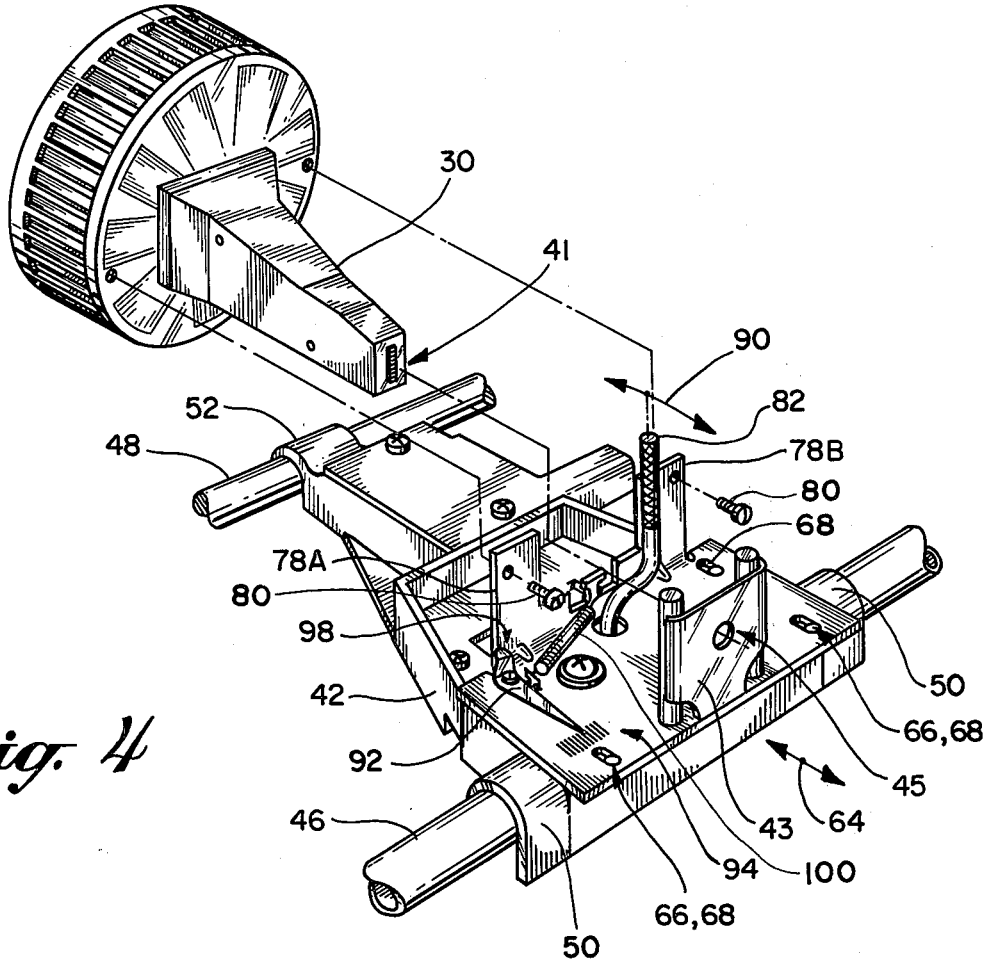
FIG. 4 is a view in perspective of means according to the invention for adjusting the position of a major component, with a component shown as exploded therefrom.
Figure 5:
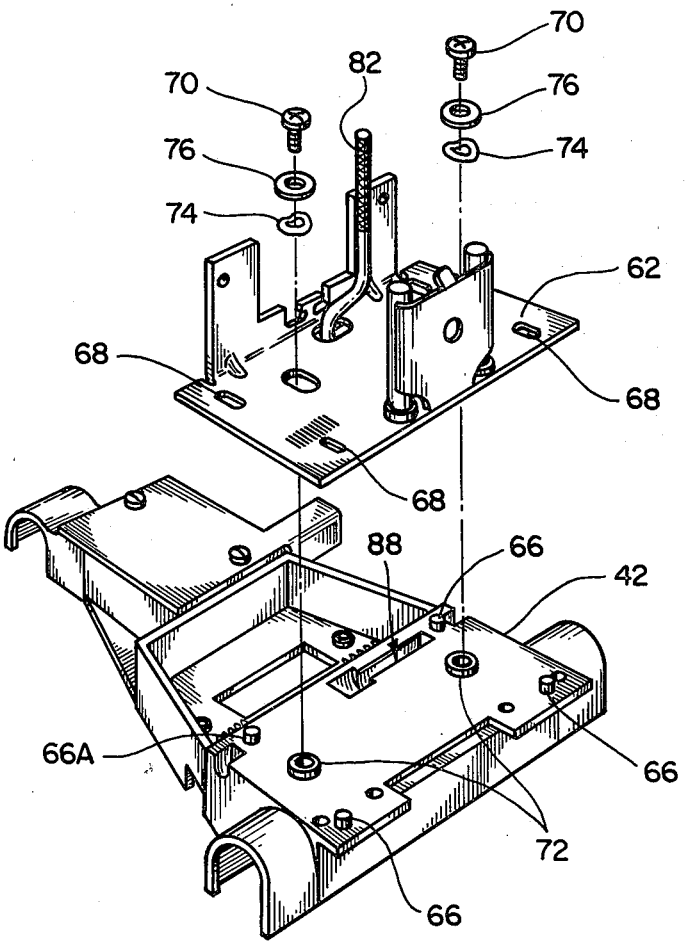
FIG. 5 is an exploded view in perspective of the means shown by FIG. 4.

FIGS. 4 and 5 depict, respectively, a preferred embodiment of the invention as assembled and as exploded. A bracket means 62 is indicated as being slidably mounted on carriage 42, providing for movement of bracket 62 toward and away from the platen 34, as indicated by the arrow 64. The sliding of bracket 62 on carriage 42 is guided by three guide pins 66, and one guide pin 66A extending from the carriage 42 for engagement with four mounting slots 68. Bracket 62 is depicted as being held in attachment to carriage 42 by two Phillips-head machine screws 70 which mate with threaded inserts 72 in carriage 42. Wavy washers 74, indicated as receiving screw pressure beneath flat washers 76, provide for applying controlled pressure on bracket 62 when screws 70 are tightened to restrain the sliding movement of bracket 62 on carriage 42.

Bracket means 62 is indicated as providing for the mounting of the print head 30 on bracket 62. Attachment is shown as being made to two legs 78A and 78B of bracket 62 by two machine screws 80.

Figure 5A:
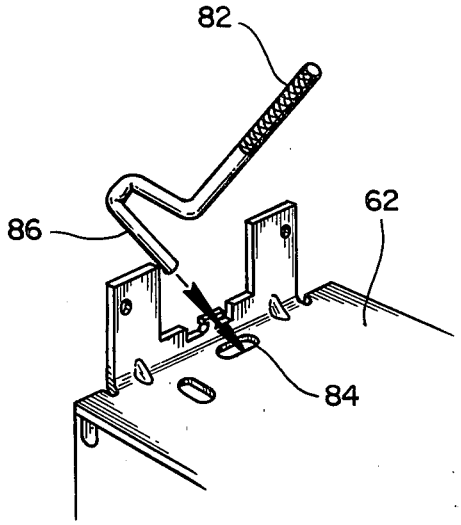
FIGS. 5A and 5B are perspective views showing additional details of the inventive means depicted in FIGS. 4 and 5.

With reference also to FIG. 5A, a bracket adjusting member, indicated in the preferred embodiment of the invention as being a lever 82, provides for the manual adjustment of the spacing of print head 30 with respect to platen 34. Lever 82, indicated as having a knurled section, is indicated as being coupled between carriage 42 and bracket 62. As shown by FIG. 5A, lever 82 is depicted as being specially formed for entry into a slot 84 in bracket 62, and for the seating of the transverse end 86 of lever 82 in a slot 88 in carriage 42. Thus, movement of lever 82 in the directions indicated by arrows 90 provide for moving bracket 62 and the print head 30, as mounted on bracket 62, towards and away from platen 34.

Figure 5B:
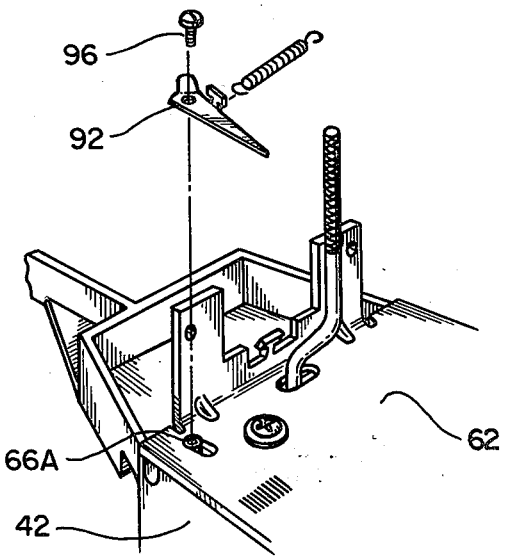

Pointer means 92, in conjunction with indicia 94, provides for a gross indication of the location of print head 30 with respect to platen 34. With reference to FIG. 5B, pointer 92 is shown as being pivotally mounted on carriage 42 by its location atop guide pin 66A, indicating as having a hole for receiving a self-tapping screw 96.

Pointer 92 is caused to pivot on guide pin 66A by its contact with leg 78A of bracket 62 at point 98. By this means, movement of bracket 62 is translated into pointer 92 movement, thus providing for a gross indication by indicia 94 of the location of print head 30 with respect to platen 34. Spring 100 provides for biasing pointer 92 so that the indicator of pointer 92 moves toward the center of bracket 62 as bracket 62 is moved away from platen 34.

By the inventive means described, the spacing between print head 30 and platen 34 can be adjusted by movement of lever 82 for print head media of various thicknesses.

While a particular embodiment of the invention has been shown and described, it will be obvious to those skilled in the art that changes and modifications may be made without departing from the invention in its broader aspects, and therefore, the aim of the appended claims is to cover all such changes and modifications which fall within the true spirit and scope of the invention.

I claim:

1. For use in a line printer having a print head supported upon a carriage for traversing a path spaced from but parallel to a platen for printing dot-matrix characters through an inked ribbon onto a print medium drawn between said ribbon and said platen, print head spacing adjustment means comprising:

a bracket, having an access aperture, slidably mounted on and overlying said carriage for enabling movement of said bracket toward and away from said platen;

means extending from said bracket for mounting said print head on said bracket;

slot means disposed in said carriage;

a bracket adjusting member consisting of a lever comprising an elongated arm terminated by an offset portion pivotally seated in said carriage slot means and captivated therein by said overlying bracket and with said elongated arm extending through said bracket access aperture and communicating with the wall of said aperture to afford manual adjustment of the spacing of said print head with respect to said platen by pivotal movement of said lever;

spring-biased pointer means pivotally mounted on said carriage and having one end thereof engaging said mounting means extending from said bracket, said bracket having indicia thereon beneath the traverse of said pointer means such that bracket movement and hence print head movement is translated into pointer movement to facilitate rapid set up of said print head by providing for a gross indication by said indicia of print head location with respect to said platen;

whereby the spacing between said print head and said platen can be quickly adjusted by movement of said lever to accommodate print media of different thicknesses.

* * * * *